US010961654B2

(12) United States Patent
Dunn et al.

(10) Patent No.: US 10,961,654 B2
(45) Date of Patent: Mar. 30, 2021

(54) VENTED CABINET CLOSED LOOP AIRFLOW CIRCUIT DRYER APPLIANCE

(71) Applicant: Haier US Appliance Solutions, Inc., Wilmington, DE (US)

(72) Inventors: David Scott Dunn, Louisville, KY (US); Jivko Ognianov Djerekarov, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 72 days.

(21) Appl. No.: 16/550,762

(22) Filed: Aug. 26, 2019

(65) Prior Publication Data

US 2021/0062402 A1 Mar. 4, 2021

(51) Int. Cl.

| | |
|---|---|
| ***F26B 3/00*** | (2006.01) |
| ***D06F 58/30*** | (2020.01) |
| *D06F 103/36* | (2020.01) |
| *D06F 103/50* | (2020.01) |
| *D06F 105/24* | (2020.01) |
| *D06F 105/26* | (2020.01) |
| *D06F 105/28* | (2020.01) |

(52) U.S. Cl.

CPC ..... *D06F 58/30* (2020.02); *D06F 2103/36* (2020.02); *D06F 2103/50* (2020.02); *D06F 2105/24* (2020.02); *D06F 2105/26* (2020.02); *D06F 2105/28* (2020.02)

(58) Field of Classification Search

CPC .. D06F 58/30; D06F 2105/26; D06F 2105/28; D06F 2105/24; D06F 2103/50; D06F 2103/36

USPC ..... 34/515, 514, 513, 443

See application file for complete search history.

(56) References Cited

U.S. PATENT DOCUMENTS

| | | | | |
|---|---|---|---|---|
| 7,020,985 | B2 | 4/2006 | Casey et al. | |
| 2018/0051409 | A1* | 2/2018 | Yu | D06F 58/20 |
| 2018/0340290 | A1* | 11/2018 | Kim | D06F 58/00 |

FOREIGN PATENT DOCUMENTS

| | | | |
|---|---|---|---|
| DE | 4409607 | C2 | 3/2002 |

* cited by examiner

*Primary Examiner* — John P McCormack

(74) *Attorney, Agent, or Firm* — Dority & Manning, P.A.

(57) ABSTRACT

A dryer appliance and a method of operating the same are provided. In one aspect, the dryer appliance includes a drum rotatably mounted within a cabinet. The cabinet defines an interior volume and a vent. The dryer appliance includes a closed loop airflow circuit along which process air is moved. The drum defines a chamber positioned along the closed loop airflow circuit. A conditioning system of the dryer appliance is also positioned along the closed loop airflow circuit and is operable to heat the process air flowing along the circuit. The dryer appliance includes a vent fan operable to move cabinet air disposed within the interior volume and not within the airflow circuit through the vent of the cabinet. The cabinet air can be vented to an outdoor space or other suitable space.

19 Claims, 5 Drawing Sheets

VENTED CABINET CLOSED LOOP AIRFLOW CIRCUIT DRYER APPLIANCE

FIELD OF THE INVENTION

The present subject matter relates generally to dryer appliances, and more particularly to closed loop airflow circuit dryer appliances, such as condenser dryer appliances, heat pump dryer appliances, and spray tower dryer appliances.

BACKGROUND OF THE INVENTION

Although closed loop airflow circuit dryer appliances can efficiently dry laundry articles, they tend to heat the laundry room or indoor space in which they are located. Particularly, electrical power drawn by such dryer appliances to power a process air conditioning system thereof eventually heats or heat soaks the laundry room. As closed loop airflow circuit dryers are generally unvented, there is nowhere for the generated heat to go besides back into the laundry room. Essentially, such dryers act as space heaters. This is particularly problematic when the laundry room air is being cooled as the waste heat output by the dryer directly counteracts the cooling process.

Accordingly, a dryer appliance and methods of operating the same that address one or more of the challenges noted above would be advantageous.

BRIEF DESCRIPTION OF THE INVENTION

Aspects and advantages of the invention will be set forth in part in the following description, or may be obvious from the description, or may be learned through practice of the invention.

In one aspect, a dryer appliance is provided. The dryer appliance includes a cabinet defining an interior volume and a vent to the interior volume. The dryer appliance also includes a drum rotatably mounted within the interior volume of the cabinet, the drum defining a chamber for the receipt of articles for drying, the chamber of the drum having a drum inlet and a drum outlet. Further, the dryer appliance includes a conditioning system operable to receive electrical power for heating process air flowing therethrough. Moreover, the dryer appliance includes a duct system for providing fluid communication between the drum outlet and the conditioning system and between the conditioning system and the drum inlet, the duct system, the conditioning system, and the drum defining a process air flowpath. The dryer appliance further includes a blower fan operable to move process air along the process air flowpath. In addition, the dryer appliance includes a vent fan positioned within the interior volume and operable to move cabinet air through the vent of the cabinet.

In another aspect, a method of operating a dryer appliance having cabinet defining an interior volume and a drum rotatably mounted therein is provided. The method includes moving, by a blower fan, process air along a process air flowpath of the dryer appliance, the process air flowpath being a closed loop airflow circuit. The method also includes heating, by a conditioning system, process air moving along the process air flowpath. Further, the method includes venting, by a vent fan, cabinet air disposed within the interior volume of the cabinet and outside of the drum through a vent defined by the cabinet.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION

Figure 1:
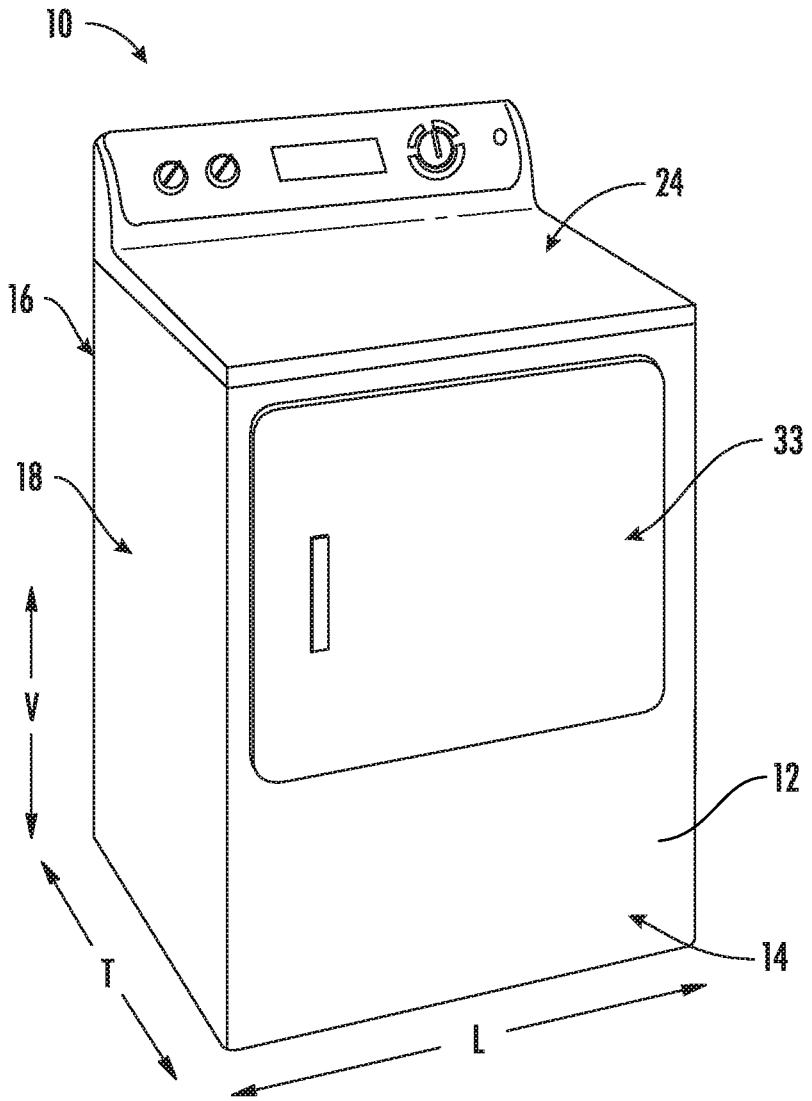
FIG. 1 provides a perspective view of a dryer appliance in accordance with exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
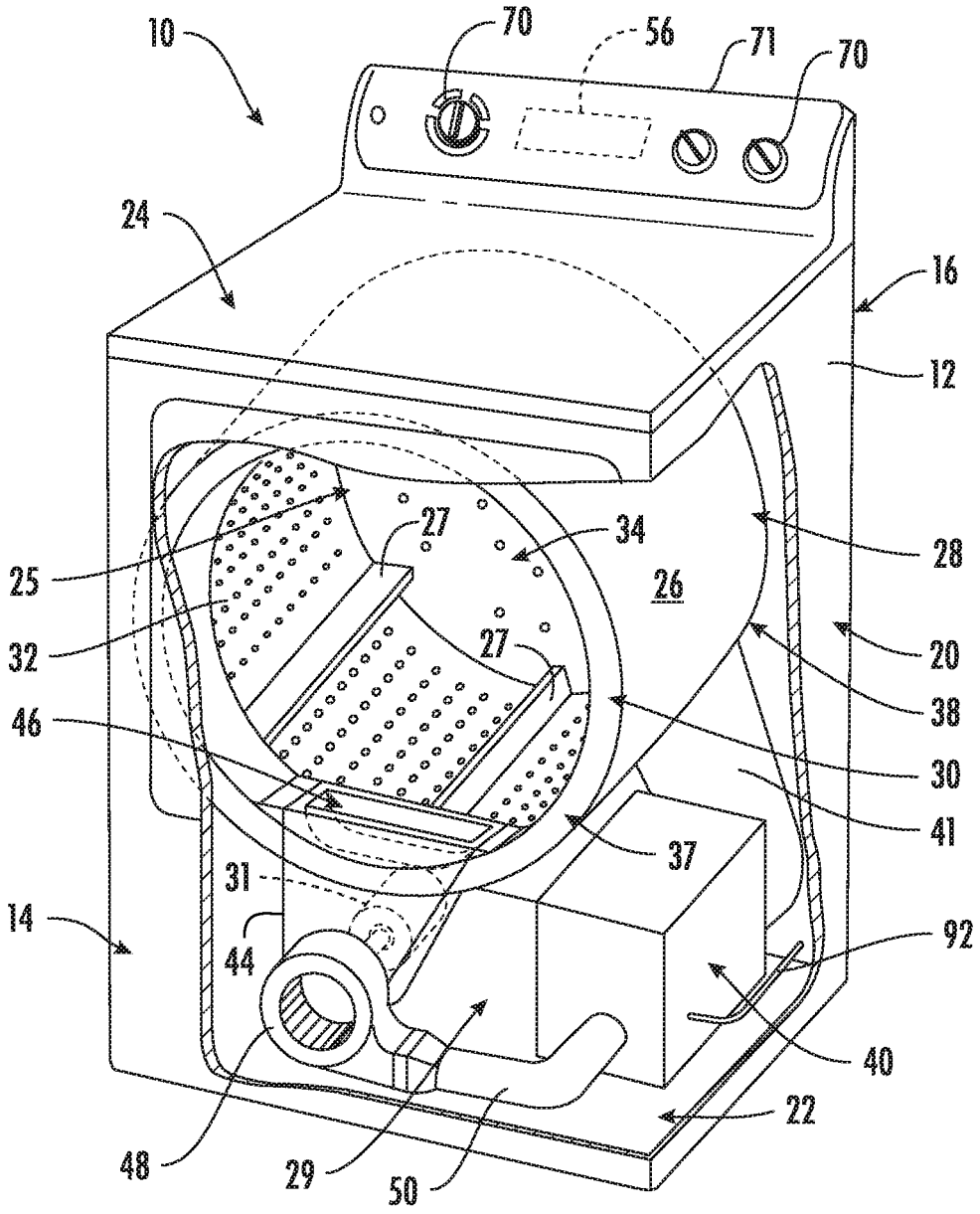
FIG. 2 provides a perspective view of the example dryer appliance of FIG. 1 with portions of a cabinet of the dryer appliance removed to reveal certain components of the dryer appliance.

FIGS. 1 and 2 provide perspective views of a dryer appliance 10 according to exemplary embodiments of the present disclosure. Particularly, FIG. 1 provides a perspective view of dryer appliance 10 and FIG. 2 provides another perspective view of dryer appliance 10 with a portion of a housing or cabinet 12 of dryer appliance 10 removed in order to show certain components of dryer appliance 10. As depicted, dryer appliance 10 defines a vertical direction V, a lateral direction L, and a transverse direction T, each of which is mutually perpendicular such that an orthogonal coordinate system is defined. While described in the context of a specific embodiment of dryer appliance 10, using the teachings disclosed herein it will be understood that dryer appliance 10 is provided by way of example only. Other dryer appliances having different appearances and different features may also be utilized with the present subject matter as well. For instance, in some embodiments, dryer appliance 10 can be a combination washing machine/dryer appliance.

Cabinet 12 includes a front panel 14, a rear panel 16, a pair of side panels 18 and 20 spaced apart from each other by front and rear panels 14 and 16 along the lateral direction L, a bottom panel 22, and a top cover 24. Cabinet 12 defines an interior volume 29. A drum or container 26 is mounted for rotation about a substantially horizontal axis within the interior volume 29 of cabinet 12. Drum 26 defines a chamber 25 for receipt of articles for tumbling and/or drying. Drum 26 extends between a front portion 37 and a back portion 38, e.g., along the transverse direction T. Drum 26 also includes a back or rear wall 34, e.g., at back portion 38 of drum 26. A supply duct 41 may be mounted to rear wall 34. Supply duct 41 receives heated air that has been heated by a conditioning system 40 and provides the heated air to drum 26 via one or more holes defined by rear wall 34.

As used herein, the terms "clothing" or "articles" includes but need not be limited to fabrics, textiles, garments, linens, papers, or other items from which the extraction of moisture is desirable. Furthermore, the term "load" or "laundry load" refers to the combination of clothing that may be washed together in a washing machine or dried together in a dryer appliance 10 (e.g., clothes dryer) and may include a mixture of different or similar articles of clothing of different or similar types and kinds of fabrics, textiles, garments and linens within a particular laundering process.

In some embodiments, a motor 31 is provided to rotate drum 26 about the horizontal axis, e.g., via a pulley and a belt (not pictured). Drum 26 is generally cylindrical in shape. Drum 26 has an outer cylindrical wall 28 and a front flange or wall 30 that defines an opening 32 of drum 26, e.g., at front portion 37 of drum 26, for loading and unloading of articles into and out of chamber 25 of drum 26. Drum 26 includes a plurality of lifters or baffles 27 that extend into chamber 25 to lift articles therein and then allow such articles to tumble back to a bottom of drum 26 as drum 26 rotates. Baffles 27 may be mounted to drum 26 such that baffles 27 rotate with drum 26 during operation of dryer appliance 10.

Rear wall 34 of drum 26 is rotatably supported within cabinet 12 by a suitable bearing. Rear wall 34 can be fixed or can be rotatable. Rear wall 34 may include, for instance, a plurality of holes that receive hot air that has been heated by a conditioning system 40, e.g., a heat pump or refrigerant-based conditioning system as will be described further below. Moisture laden, heated air is drawn from drum 26 by an air handler, such as a blower fan 48, which generates a negative air pressure within drum 26. The moisture laden heated air passes through a duct 44 enclosing screen filter 46, which traps lint particles. As the air passes from blower fan 48, it enters a duct 50 and then is passed into conditioning system 40. In some embodiments, dryer appliance 10 may be a conventional dryer appliance, e.g., the conditioning system 40 may be or include an electric heating element, e.g., a resistive heating element, or a gas-powered heating element, e.g., a gas burner. For this embodiment, dryer appliance 10 is a closed loop airflow circuit dryer appliance, and more particularly, a heat pump dryer. In such embodiments, conditioning system 40 may be or include a heat pump including a sealed refrigerant circuit, as described in more detail below with reference to FIG. 3. Heated air (with a lower moisture content than was received from drum 26), exits conditioning system 40 and returns to drum 26 by duct 41. After the clothing articles have been dried, they are removed from the drum 26 via opening 32. A door 33 provides for closing or accessing drum 26 through opening 32.

In some embodiments, one or more selector inputs 70, such as knobs, buttons, touchscreen interfaces, etc., may be provided or mounted on a cabinet 12 (e.g., on a backsplash 71) and are communicatively coupled with (e.g., electrically coupled or coupled through a wireless network band) a processing device or controller 56. Controller 56 may also be communicatively coupled with various operational components of dryer appliance 10, such as motor 31, blower 48, and/or components of conditioning system 40. In turn, signals generated in controller 56 direct operation of motor 31, blower 48, or conditioning system 40 in response user inputs to selector inputs 70. As used herein, "processing device" or "controller" may refer to one or more microprocessors, microcontroller, ASICS, or semiconductor devices and is not restricted necessarily to a single element. The controller 56 may be programmed to operate dryer appliance 10 by executing instructions stored in memory (e.g., non-transitory media). The controller 56 may include, or be associated with, one or more memory elements such as RAM, ROM, or electrically erasable, programmable read only memory (EEPROM). For example, the instructions may be software or any set of instructions that when executed by the processing device, cause the processing device to perform operations. It should be noted that controller 56 as disclosed herein is capable of and may be operable to perform any methods or associated method steps as disclosed herein. For example, in some embodiments, methods disclosed herein may be embodied in programming instructions stored in the memory and executed by the controller 56.

Figure 3:
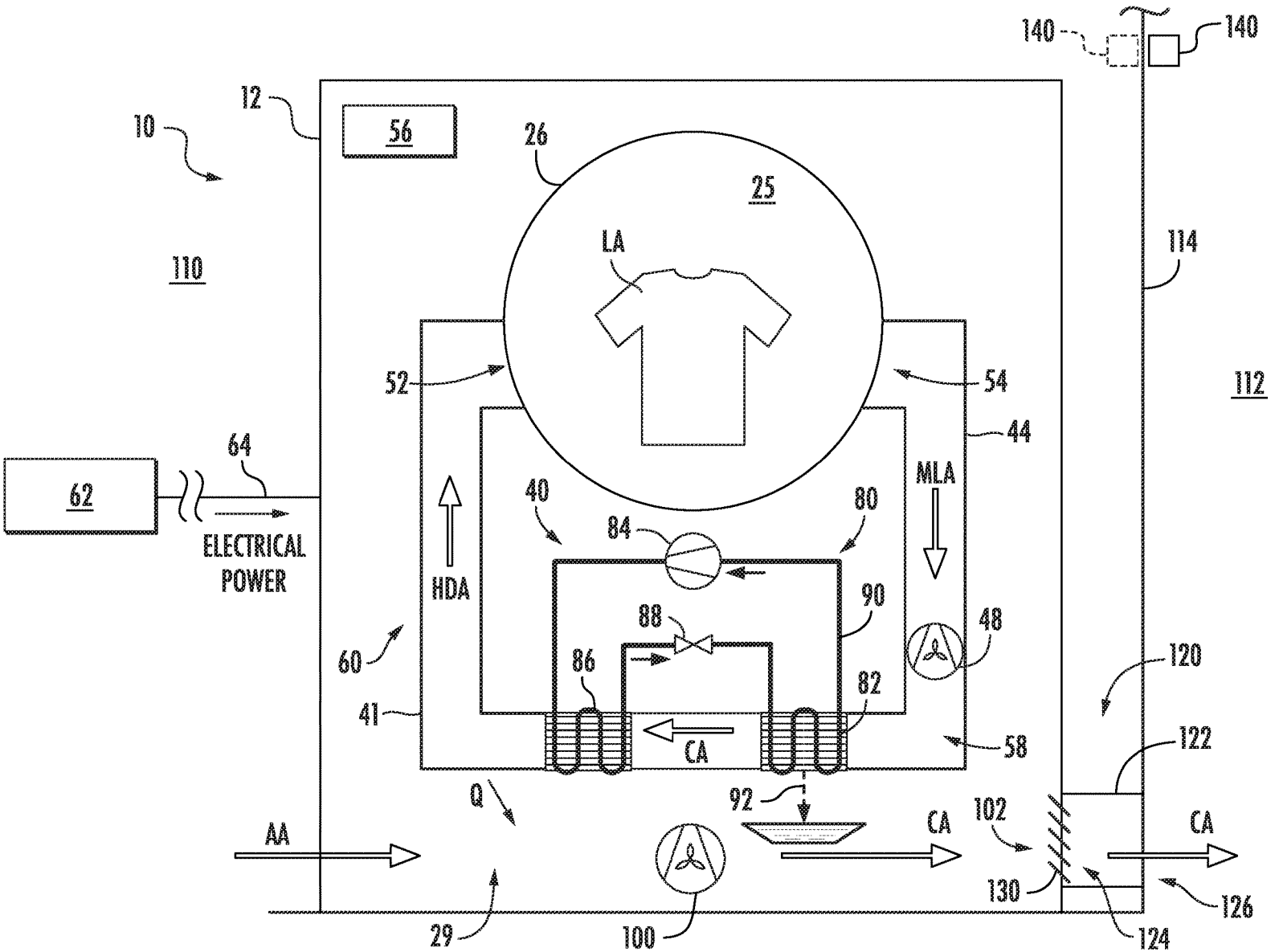
FIG. 3 provides a schematic diagram of the dryer appliance of FIGS. 1 and 2 and a conditioning system thereof and depicts the dryer appliance operating in a vented mode.

FIG. 3 provides a schematic view of dryer appliance 10 and depicts conditioning system 40 in more detail. For this embodiment, dryer appliance 10 is a heat pump dryer appliance and thus conditioning system 40 includes a sealed system 80. Sealed system 80 includes various operational components, which can be encased or located within a machinery compartment of dryer appliance 10. Generally, the operational components are operable to execute a vapor compression cycle for heating air passing through conditioning system 40. The operational components of sealed system 80 include an evaporator 82, a compressor 84, a condenser 86, and one or more expansion devices 88 connected in series along a refrigerant circuit or line 90. Refrigerant line 90 is charged with a refrigerant. Sealed system 80 depicted in FIG. 3 is provided by way of example only. Thus, it is within the scope of the present subject matter for other configurations of the sealed system to be used as well. As will be understood by those skilled in the art, sealed system 80 may include additional components, e.g., at least one additional evaporator, compressor, expansion device, and/or condenser. As an example, sealed system 80 may include two (2) evaporators.

In performing a drying and/or tumbling cycle, one or more laundry articles LA may be placed within the chamber 25 of drum 26. Hot dry air HDA is supplied to chamber 25 via duct 41. The hot dry air HDA enters chamber 25 of drum via a drum inlet 52 defined by drum 26, e.g., the plurality of holes defined in rear wall 34 of drum 26 as shown in FIG. 2. The hot dry air HDA provided to chamber 25 causes moisture within laundry articles LA to evaporate. Accordingly, the air within chamber 25 increases in water content and exits chamber 25 as warm moisture laden air MLA. The warm moisture laden air MLA exits chamber 25 through a drum outlet 54 defined by drum 26 and flows into duct 44.

After exiting chamber 25 of drum 26, the warm moisture laden air MLA flows downstream to conditioning system 40. Blower fan 48 moves the warm moisture laden air MLA, as well as the air more generally, through a process air flowpath 58 defined by drum 26, conditioning system 40, and the duct system 60. Thus, generally, blower fan 48 is operable to move air through or along the process air flowpath 58. For this embodiment, the process air flowpath 58 is a closed loop airflow circuit. Duct system 60 includes all ducts that provide fluid communication (e.g., airflow communication) between drum outlet 54 and conditioning system 40 and between conditioning system 40 and drum inlet 52. Although blower fan 48 is shown positioned between drum 26 and conditioning system 40 along duct 44, it will be appreciated that blower fan 48 can be positioned in other suitable positions or locations along duct system 60.

As further depicted in FIG. 3, the warm moisture laden air MLA flows into or across evaporator 82 of the conditioning system 40. As the moisture laden air MLA passes across evaporator 82, the temperature of the air is reduced through heat exchange with refrigerant that is vaporized within, for example, coils or tubing of evaporator 82. This vaporization process absorbs both the sensible and the latent heat from the moisture laden air MLA—thereby reducing its temperature. As a result, moisture in the air is condensed and such condensate may be drained from heating assembly 40, e.g., using a drain line 92, which is also depicted in FIG. 2.

Air passing over evaporator 82 becomes cooler than when it exited drum 26 at drum outlet 54. As shown, cool air CA (cool relative to hot dry air HDA and moisture laden air MLA) flowing downstream of evaporator 82 is subsequently caused to flow across condenser 86, e.g., across coils or tubing thereof, which condenses refrigerant therein. The refrigerant enters condenser 86 in a gaseous state at a relatively high temperature compared to the cool air CA from evaporator 82. As a result, heat energy is transferred to the cool air CA at the condenser 86, thereby elevating its temperature and providing warm dry air HDA for resupply to drum 26 of dryer appliance 10. The warm dry air HDA passes over and around laundry articles LA within the chamber 25 of the drum 26, such that warm moisture laden air MLA is generated, as mentioned above. Because the air is recycled through drum 26 and conditioning system 40, dryer appliance 10 can have a much greater efficiency than traditional clothes dryers where all of the warm, moisture laden air MLA is exhausted to the environment.

With respect to sealed system 80, compressor 84 pressurizes refrigerant (i.e., increases the pressure of the refrigerant) passing therethrough and generally motivates refrigerant through the sealed refrigerant circuit or refrigerant line 90 of conditioning system 40. Compressor 84 may be communicatively coupled with controller 56 (communication lines not shown in FIG. 3). Refrigerant is supplied from the evaporator 82 to compressor 84 in a low pressure gas phase. The pressurization of the refrigerant within compressor 84 increases the temperature of the refrigerant. The compressed refrigerant is fed from compressor 84 to condenser 86 through refrigerant line 90. As the relatively cool air CA from evaporator 82 flows across condenser 86, the refrigerant is cooled and its temperature is lowered as heat is transferred to the air for supply to chamber 25 of drum 26.

Upon exiting condenser 86, the refrigerant is fed through refrigerant line 90 to expansion device 88. Although only one expansion device 88 is shown, such is by way of example only. It is understood that multiple such devices may be used. In the illustrated example, expansion device 88 is an electronic expansion valve, although a thermal expansion valve or any other suitable expansion device can be used. In additional embodiments, any other suitable expansion device, such as a capillary tube, may be used as well. Expansion device 88 lowers the pressure of the refrigerant and controls the amount of refrigerant that is allowed to enter the evaporator 82. Importantly, the flow of liquid refrigerant into evaporator 82 is limited by expansion device 88 in order to keep the pressure low and allow expansion of the refrigerant back into the gas phase in evaporator 82. The evaporation of the refrigerant in evaporator 82 converts the refrigerant from its liquid-dominated phase to a gas phase while cooling and drying the moisture laden air MLA received from chamber 25 of drum 26. The process is repeated as air is circulated along process air flowpath 58 while the refrigerant is cycled through sealed system 80, as described above.

Although dryer appliance 10 is depicted and described herein as a heat pump dryer appliance, the inventive aspects of the present disclosure can apply to other types of closed loop airflow circuit dryer appliances. For instance, in other embodiments, dryer appliance 10 can be a condenser dryer that utilizes an air-to-air heat exchanger instead of evaporator 82 and/or an electric heater may be provided instead of condenser 86. In yet other embodiments, dryer appliance 10 can be a spray tower dryer appliance that utilizes a water-to-air heat exchanger instead of utilizing a sealed refrigerant. Further, in some embodiments, dryer appliance 10 can be a combination washer/dryer appliance having a closed loop airflow circuit along which process air may flow for drying operations.

A power source 62 is in electrical communication with dryer appliance 10. For this embodiment, an electrical conduit 64 can provide electrical communication between power source 62 and dryer appliance 10. Dryer appliance 10 can draw or otherwise receive electrical power from power source 62. The received electrical power can be utilized to power various electrical loads of dryer appliance 10, such as compressor 84, blower fan 48, controller 56, as well as other components not expressly listed. Conditioning system 40 is operable to receive electrical power for heating process air flowing therethrough.

As noted previously, conventional condenser heat pump dryer appliances have tended to heat soak the indoor space in which they are located. In accordance with the inventive aspects of the present disclosure, dryer appliance 10 includes features for directing waste heat to a space other than the indoor space in which dryer appliance 10 is located. More specifically, dryer appliance 10 includes features for moving or venting cabinet air from within interior volume 29 (i.e., air located within the interstitial space outside of chamber 25 of drum 26 and within cabinet 12) to an outdoor space or other suitable space.

Referring still to FIG. 3, dryer appliance 10 is depicted operating in a vented mode. In some instances, controller 56 can operate dryer appliance 10 in the vented mode when it is desired to not heat soak indoor space 110 with the heated cabinet air CA. Thus, the vented mode is particularly useful during the summer or warmer months of the year. As shown, ambient air AA from an indoor space 110 enters interior volume 29 of cabinet 12. Dryer appliance 10 is located within indoor space 110. An exterior wall 114 separates indoor space 110 from outdoor space 112. When the ambient air AA enters interior volume 29 of cabinet 12, the ambient air becomes cabinet air CA. As depicted, conditioning system 40 and the duct system 60 are in thermal communication with the cabinet air CA disposed within interior volume 29 of cabinet 12. More specifically, the relatively hot process air within duct system 60 and conditioning system 40 impart waste heat to the cabinet air CA. Other components, such as compressor 84, also impart waste heat to the cabinet air CA. Accordingly, the electrical power delivered to dryer appliance 10 is rejected as waste heat to the cabinet air CA. Consequently, the cabinet air CA increases in temperature.

Dryer appliance 10 includes a vent fan 100 positioned within interior volume 29 of cabinet 12. Vent fan 100 can be a centrifugal blower, for example. Vent fan 100 is operable to move or vent cabinet air CA through a vent 102 of cabinet 12. In some embodiments, vent fan 100 is operable to move at least forty cubic feet per minute (40 CFM) (1.13 $m^3$/min) of cabinet air CA through vent 102 of cabinet 12. Vent fan 100 is communicatively coupled with controller 56, e.g., via a suitable wired or wireless communication link. Controller 56 can activate or cause vent fan 100 to move cabinet air CA, e.g., based on one or more control commands. For instance, vent fan 100 is shown in FIG. 3 moving cabinet air CA through interior volume 29 and toward vent 102 of cabinet 12. Controller 56 can cause vent fan 100 to move cabinet air CA continuously during a drying cycle or during the steady state portion of the drying cycle, at predetermined intervals, or based one or more trigger conditions. As one example, controller 56 can cause vent fan 100 to move cabinet air CA when the temperature of the air of indoor space 110 and/or outdoor space 112 has passed a temperature threshold. Controller 56 can also deactivate or cause vent fan 100 to cease moving cabinet air CA, e.g., based on one or more control commands.

A vent system 120 having one or more vent ducts 122 is in fluid communication with vent 102. Particularly, vent 102 is in fluid communication with an inlet 124 of vent system 120. In this manner, vent system 120 can receive cabinet air CA expelled or exhausted from interior volume 29 of cabinet 12. As further shown in FIG. 3, vent system 120 has an outlet 126 in fluid communication with outdoor space 112. In other embodiments, the outlet 126 of vent system 120 can be in fluid communication with another suitable space or another system operable to receive waste heat. The expelled cabinet air CA can flow downstream through the one or more vent ducts 122 of vent system 120 to the outlet 126 thereof where the cabinet air CA can be exhausted to outdoor space 112. Thus, heated cabinet air CA is exhausted to a suitable space rather than indoor space 110. In this manner, indoor space 110 is prevented from being heat soaked by the heated cabinet air CA. Notably, the heated cabinet air CA exhausted to outdoor space 112 does not contain combustion products or lint as no gas is used as a fuel source for providing heat and the cabinet air CA does not mix with the process air within the closed loop process air flowpath 58. Accordingly, the cabinet air CA exhausted to outdoor space 112 is of higher quality than air exhausted by a conventional vented dryer appliance. Thus, the exhausted cabinet air CA is more environmentally friendly.

In some embodiments, optionally, cabinet 12 has a vent damper 130 positioned at the vent 102. Vent damper 130 is movable between an open position and a closed position. When vent damper 130 is in the open position, cabinet air CA may exit interior volume 29 of cabinet 12 through vent 102. In contrast, when vent damper 130 is in the closed position, cabinet air CA is prevented from exiting or flowing out of interior volume 29 of cabinet 12 through vent 102. Vent damper 130 is shown in the open position in FIG. 3 and in the closed position in FIG. 4.

Vent damper 130 is communicatively coupled with controller 56, e.g., via a suitable wired or wireless communication link. Controller 56 can move vent damper 130 between the open and closed positions. For instance, when vent fan 100 is activated to move cabinet air CA through vent 102, controller 56 can cause vent damper 130 to move to the open position so that the heated cabinet air CA can be expelled from interior volume 29 to vent system 120 and ultimately to outdoor space 112 or some other suitable space. In some instances, when vent fan 100 is deactivated such that vent fan 100 ceases moving cabinet air CA through vent 102, controller 56 can cause vent damper 130 to move to the closed position. In this way, particularly if dryer appliance 10 is not in operation, air is preventing from entering indoor space 110 through dryer appliance 10. Accordingly, in some embodiments, vent damper 130 can be controlled in sync with vent van 100. In other embodiments, particularly if passive venting of the cabinet air CA is desired, vent damper 130 can be moved to an open position by controller 56 while vent fan 100 is not active.

Figure 4:
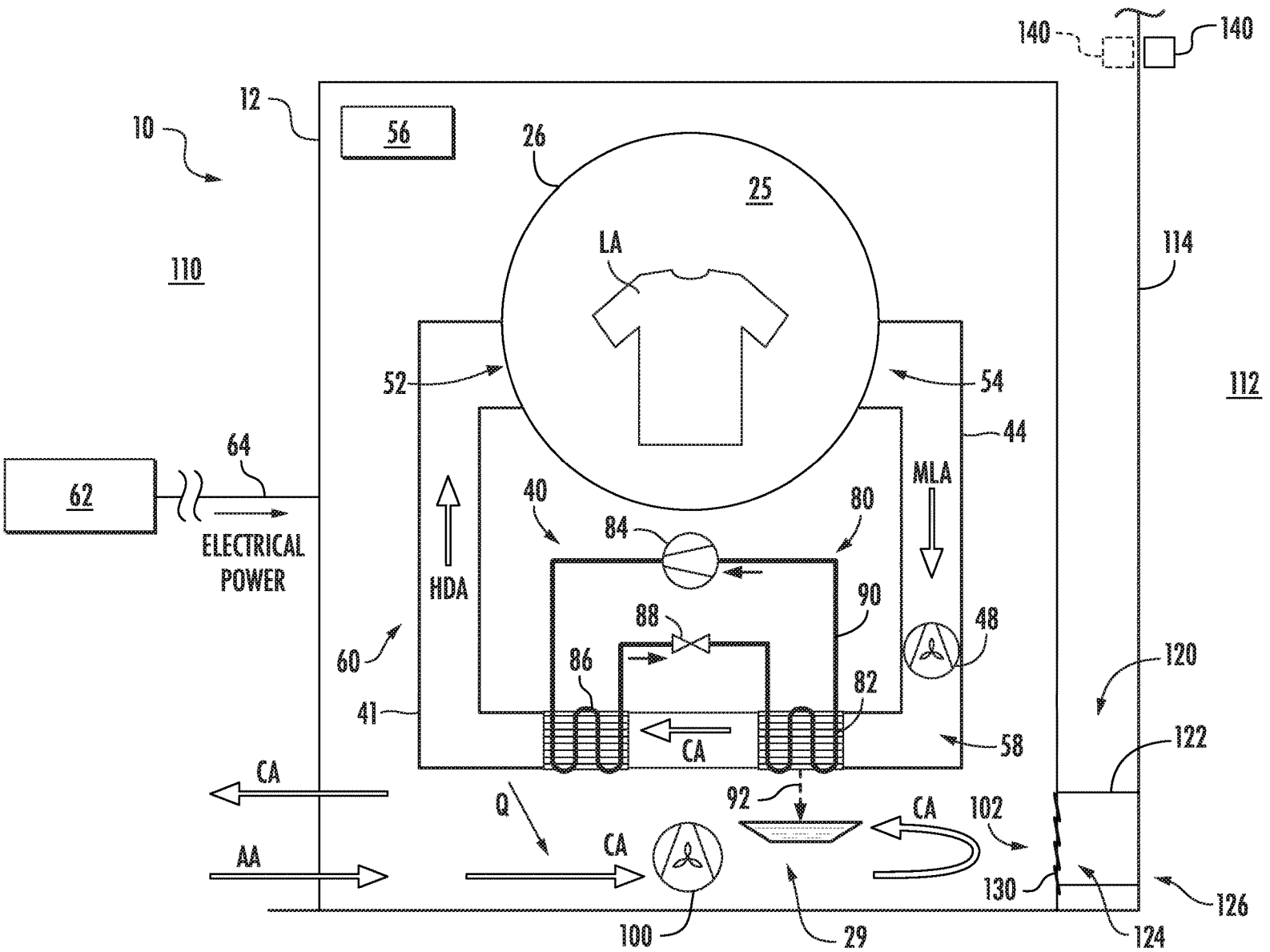
FIG. 4 provides another schematic diagram of the dryer appliance of FIGS. 1 and 2 and depicts the dryer appliance operating in a non-vented mode.

FIG. 4 provides another schematic diagram of dryer appliance 10 and depicts the dryer appliance 10 operating in a non-vented mode. In some instances, controller 56 can operate dryer appliance 10 in a non-vented mode when it is desired to heat indoor space 110 with the heated cabinet air CA. Thus, the non-vented mode is particularly useful during the winter or cooler months of the year. As shown, ambient air AA from indoor space 110 enters interior volume 29 of cabinet 12. When the ambient air AA enters interior volume 29 of cabinet 12, the ambient air becomes cabinet air CA. As noted above, conditioning system 40 and the duct system 60 are in thermal communication with the cabinet air CA disposed within interior volume 29 of cabinet 12. Consequently, the relatively hot process air within duct system 60 and conditioning system 40 impart waste heat to the cabinet air CA. Other components of dryer appliance 10 also impart waste heat to the cabinet air CA. Accordingly, the electrical power delivered to dryer appliance 10 is rejected as waste heat to the cabinet air CA. Consequently, the cabinet air CA increases in temperature.

In the non-vented mode, vent fan 100 is operable to either move or vent heated cabinet air CA to indoor space 110, or if passive heating is desirable, vent fan 100 can be deactivated by controller 56. In instances in which vent fan 100 is activated to move heated cabinet air CA to indoor space 110, vent fan 100 can be rotated in a direction opposite the rotation direction when venting cabinet air CA through vent 102 is desired. Notably, in the non-vented mode, controller 56 can cause vent damper 130 to move to a closed positioned such that heated cabinet air CA is prevented from exiting interior volume 29 through vent 102 thus keeping the heated cabinet air CA within interior volume 29. In this manner, the heated cabinet air CA can be exhausted into indoor space 110. Advantageously, by exhausting heated cabinet air CA into indoor space 110, the burden placed on a heating system operable to heat indoor space 110 is lessened or reduced as dryer appliance 10 actively heats indoor space 110 with waste heat imparted to the cabinet air CA. Furthermore, notably, the heated cabinet air CA exhausted into indoor space 110 does not contain combustion products, lint, and relatively little moisture as no gas is used as a fuel source for providing heat and the cabinet air CA does not mix with the process air within the closed loop process air flowpath 58.

In some embodiments, controller 56 can automatically select or toggle between the vented and non-vented modes. For instance, in some embodiments, controller 56 can be communicatively coupled with a temperature sensor, e.g., via a suitable wired or wireless communication link. In some embodiments, the temperature sensor is operable to sense a temperature of the air within indoor space 110. In other embodiments, the temperature sensor is operable to sense a temperature of the air within outdoor space 112. For instance, as shown in FIGS. 3 and 4, a temperature sensor 140 can be placed within indoor space 110 (shown in phantom lines) or within outdoor space 112. Although temperature sensor 140 is shown positioned offboard of dryer appliance 10, temperature sensor 140 can be positioned onboard dryer appliance 10 as well. In some embodiments, multiple temperatures sensors can be provided. For instance, an indoor temperature sensor and an outdoor temperature sensor can be provided and can be communicatively coupled with controller 56.

In some example embodiments, controller 56 is configured to receive an input indicative of a temperature of the air within outdoor space 112. Controller 56 can then determine whether the temperature of the air within outdoor space 112 has passed a threshold temperature. As one example, the threshold temperature can be an upper threshold temperature, e.g., seventy degrees Fahrenheit (70° F.) or (21° C.). In this example, if the sensed temperature has passed or is greater than seventy degrees Fahrenheit (70° F.), then controller 56 determines that the temperature of the air within outdoor space 112 has passed the threshold temperature. As another example, the threshold temperature can be a lower threshold temperature, e.g., thirty-two degrees Fahrenheit (32° F.) or (0° C.). In this example, if the sensed temperature has passed or is less than thirty-two degrees Fahrenheit (32° F.), then controller 56 determines that the temperature of the air within outdoor space 112 has passed the threshold temperature. In such embodiments, when the temperature of the air within outdoor space 112 has passed the threshold temperature, controller 56 can cause dryer appliance 10 to switch or toggle to either the vented mode or the non-vented mode depending on the temperature threshold passed.

For example, if the sensed temperature has passed or is greater than the upper threshold temperature, then controller 56 can automatically switch to or operate in the vented mode. Particularly, controller 56 can cause vent damper 130 to move to an open positioned and vent fan 100 to move cabinet air CA through vent 102 and vent damper 130 to ultimately vent or exhaust the heated cabinet air CA to outdoor space 112 or some other desirable space. On the other hand, if the sensed temperature has passed or is less than the lower threshold temperature, then controller 56 can automatically switch to or operate in the non-vented mode. Particularly, controller 56 can cause vent damper 130 to move to the closed positioned and vent fan 100 to cease operation or alternatively facilitate moving cabinet air CA out of interior volume 29 to indoor space 110.

In yet other example embodiments, controller 56 is configured to receive an input indicative of a temperature of the air within indoor space 110, which is the space in which dryer appliance 10 is positioned or located. Controller 56 can also receive an input indicative of a temperature set point of the air within indoor space 110, e.g., from a thermostat of a heating system operable to condition the air disposed within indoor space 110. The temperature set point is representative of the desired temperature of the air within indoor space 110. In such embodiments, controller 56 can then determine whether the temperature of the air within indoor space 110 is within a predetermined range of the temperature set point. In such embodiments, when the temperature of the air within indoor space 110 is within a predetermined range of the temperature set point, controller 56 can cause dryer appliance 10 to remain in its current mode. On the other hand, when the temperature of the air within indoor space 110 is not within the predetermined range of the temperature set point, controller 56 can cause dryer appliance 10 to switch to the other mode.

By way of example, suppose the sensed temperature of the air within indoor space is sixty degrees Fahrenheit (60° F.) or (15.5° C.) and the set point temperature is seventy degrees Fahrenheit (70° F.) or (21° C.). Further, suppose that the predetermined range of the temperature set point is plus or minus five degrees Fahrenheit (±5° F.). In such embodiments, controller 56 receives an input indicative of the temperature of the air within indoor space 110, which in this example is sixty degrees Fahrenheit (60° F.). Controller 56 also receives an input indicative of a temperature set point of the air within indoor space 110, which in this example is seventy degrees Fahrenheit (70° F.). Controller 56 determines whether the temperature of the air within indoor space 110 is within the predetermined range of the temperature set point. In this example, sixty degrees Fahrenheit (60° F.) is not within plus or minus five degrees Fahrenheit (±5° F.) of the set point temperature, which is seventy degrees Fahrenheit (70° F.). Accordingly, controller 56 can cause dryer appliance 10 to automatically switch to the non-vented mode. In the non-vented mode, controller 56 can deactivate vent fan 100 and/or closing vent damper 130, e.g., as shown in FIG. 4. In this manner, heated cabinet air CA can escape from interior volume 29 of cabinet 12 into indoor space 110 to provide heat. Furthermore, once the sensed temperature is within the predetermined range of the temperature set point, controller 56 can automatically switch back to the vented mode so as not to overly heat indoor space 110. To return to the vented mode, as noted above, controller 56 can cause vent damper 130 to open and can cause vent fan 100 to move the heated cabinet air CA through vent 102 so that it may be exhausted, e.g., to outdoor space 112.

Figure 5:
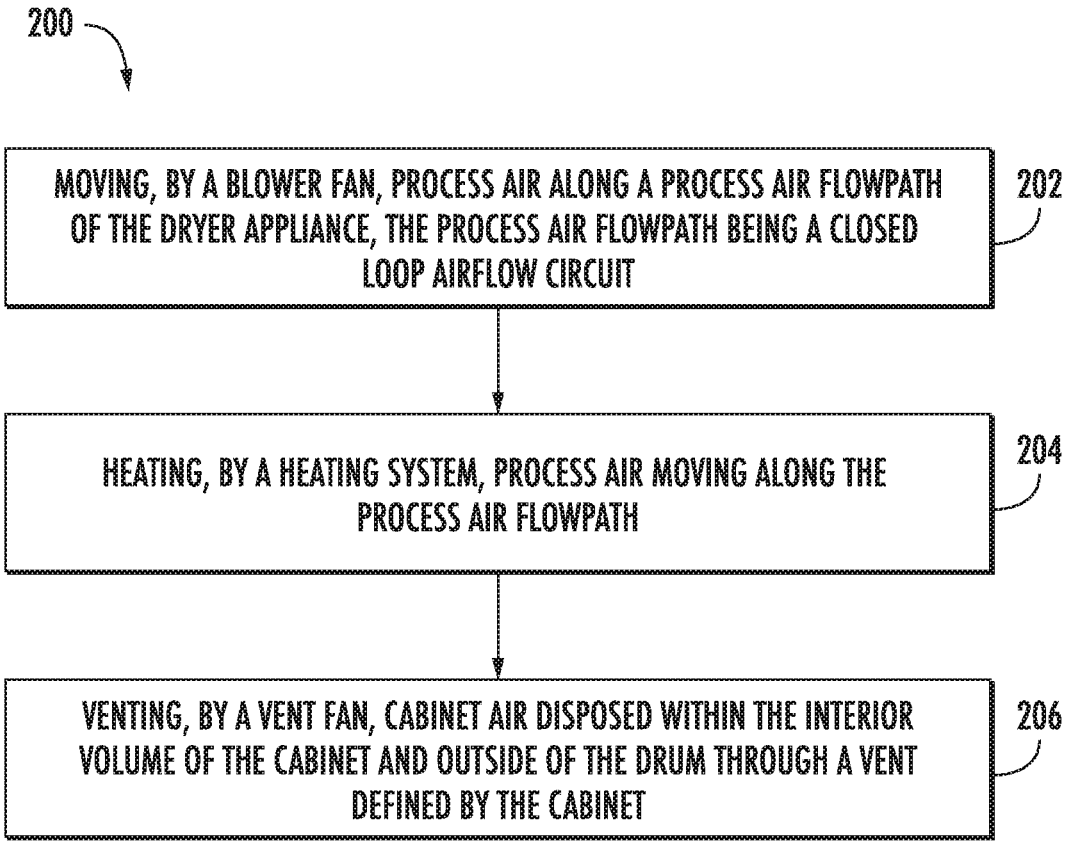
FIG. 5 provides a flow chart of an exemplary method of operating a dryer appliance according to one or more embodiments of the present disclosure.

FIG. 5 provides a flow diagram of an example method (200) of operating a dryer appliance having cabinet defining an interior volume and a drum rotatably mounted therein. For instance, the dryer appliance 10 described herein can be operated as set forth in method (200). FIG. 5 depicts steps performed in a particular order for purposes of illustration and discussion. Those of ordinary skill in the art, using the disclosures provided herein, will understand that various steps of any of the methods disclosed herein can be modified in various ways without deviating from the scope of the present disclosure.

At (202), the method (200) includes moving, by a blower fan, process air along a process air flowpath of the dryer appliance, the process air flowpath being a closed loop airflow circuit. For instance, as shown in FIGS. 3 and 4, blower fan 48 can move the process air along duct 44 of duct system 60, through conditioning system 40, along supply duct 41 of duct system 60, and through chamber 25 of chamber 26. As depicted, duct system 60, conditioning system 40, and chamber 25 of drum 26 form a closed loop airflow circuit.

At (204), the method (200) includes heating, by a conditioning system, process air moving along the process air flowpath. For instance, the conditioning system can be conditioning system 40 of FIGS. 3 and 4. As shown, conditioning system 40 is a heat pump having sealed system 80. Electrical power can be provided from power source 62 to dryer appliance 10 via electrical conduit 64. The received electrical power can be utilized by various components of sealed system 80 to remove moisture from the process air and to provide heat thereto. Notably, during operation of dryer appliance 10 in a drying cycle, the heated process air moving along the process air flowpath 58 and the conditioning system 40 impart thermal energy to the cabinet air CA disposed within interior volume 29 of the cabinet 12, e.g., as shown by the arrow labeled "Q" in FIGS. 3 and 4. The heated cabinet air can be selectively vented from interior volume 29 as provided below and noted herein.

At (206), the method (200) includes venting, by a vent fan, cabinet air disposed within the interior volume of the cabinet and outside of the drum through a vent defined by the cabinet. For instance, the vent fan can be the vent fan 100 depicted in FIGS. 3 and 4. Vent fan 100 can be disposed within interior volume 29 of cabinet 12 and outside of drum 26. As illustrated in FIG. 3, vent fan 100 can be activated to move cabinet air through vent 102 of cabinet 12. Vent 102 of cabinet 12 can be in fluid communication with outdoor space 112 (or some other suitable space), and when the vent fan 100 vents cabinet air CA (i.e., the air disposed within interior volume 29 of cabinet 12 and outside of drum 26) through vent 102 defined by cabinet 12, cabinet air CA is vented to outdoor space 112. By venting cabinet air CA to another space besides indoor space 110, such as e.g., outdoor space 112, the heated cabinet air CA does not heat soak laundry room or indoor space 110 in which dryer appliance 10 is positioned.

In some implementations of method (200), a vent damper is positioned at the vent of the cabinet. For instance, the vent damper can be the vent damper 130 depicted in FIGS. 3 and 4. The vent damper 130 can movable between an open position in which cabinet air CA exits interior volume 29 of cabinet 12 through vent 102 (e.g., shown in FIG. 3) and a closed position in which cabinet air CA is prevented from exiting interior volume 29 of cabinet 12 through vent 102 (e.g., as shown in FIG. 4). In such implementations, the method (200) further includes moving the vent damper to the open position so that cabinet air is vented through the vent. In this way, the cabinet air CA can be vented through vent 102 by vent fan 100.

In some implementations, the method (200) includes receiving, by a controller of the dryer appliance and from a temperature sensor, an input indicative of a temperature of air within an outdoor space. The method (200) can also include determining whether the temperature of air within the outdoor space has passed a threshold temperature. When the temperature of air within the outdoor space has passed the threshold temperature, causing, by the controller, the dryer appliance to automatically switch to one of a vented mode and a non-vented mode. In the vented mode, the controller can cause the vent damper to move to the open position and the vent fan to move cabinet air through the vent of the cabinet. In the non-vented mode, the controller can cause the vent damper to move to the closed position.

In some implementations, the method (200) includes receiving, by a controller and from a temperature sensor, an input indicative of a temperature of air within an indoor space in which the dryer appliance is positioned. The method (200) also includes receiving, by the controller, an input indicative of a set point temperature for air within the indoor space. Further, the method (200) includes determining whether the temperature of air within the indoor space is within a predetermined range of the set point temperature. In response to whether the temperature of air within the indoor space is within the predetermined range of the set point temperature, the method (200) includes causing, by the controller, the dryer appliance to automatically switch to one of a vented mode and a non-vented mode. In the vented mode, the controller can cause the vent damper to move to the open position and the vent fan to move cabinet air through the vent of the cabinet. In the non-vented mode, the controller can cause the vent damper to move to the closed position.

Although specific features of various embodiments may be shown in some drawings and not in others, this is for convenience only. In accordance with the principles of the present disclosure, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dryer appliance, comprising:

a cabinet defining an interior volume and a vent to the interior volume;

a drum rotatably mounted within the interior volume of the cabinet, the drum defining a chamber for the receipt of articles for drying, the chamber of the drum having a drum inlet and a drum outlet;

a conditioning system operable to receive electrical power for heating process air flowing therethrough;

a duct system for providing fluid communication between the drum outlet and the conditioning system and between the conditioning system and the drum inlet, the duct system, the conditioning system, and the drum defining a process air flowpath;

a blower fan operable to move process air along the process air flowpath; and a vent fan positioned within the interior volume and operable to move cabinet air through the vent of the cabinet.

2. The dryer appliance of claim 1, wherein the conditioning system and the duct system are in thermal communication with cabinet air disposed within the interior volume of the cabinet.

3. The dryer appliance of claim 1, wherein the cabinet has a vent damper positioned at the vent, the vent damper being movable between an open position in which cabinet air exits the interior volume of the cabinet through the vent and a closed position in which cabinet air is prevented from exiting the interior volume of the cabinet through the vent.

4. The dryer appliance of claim 3, further comprising:

a controller communicatively coupled with the damper, the vent fan, and a temperature sensor, the controller configured to:

receive, from the temperature sensor, an input indicative of a temperature of air within an outdoor space;

determine whether the temperature of air within the outdoor space has passed a threshold temperature, and when the temperature of air within the outdoor space has passed the threshold temperature, cause the dryer appliance to automatically switch to one of a vented mode and a non-vented mode, and wherein in the vented mode, the controller causes the vent damper to move to the open position and the vent fan to move cabinet air through the vent of the cabinet, and wherein in the non-vented mode, the controller causes the vent damper to move to the closed position.

5. The dryer appliance of claim 3, further comprising:

a controller communicatively coupled with the damper, the vent fan, and a temperature sensor, the controller configured to:

receive, from the temperature sensor, an input indicative of a temperature of air within an indoor space in which the dryer appliance is positioned;

receive an input indicative of a set point temperature for air within the indoor space;

determine whether the temperature of air within the indoor space is within a predetermined range of the set point temperature, and in response to whether the temperature of air within the indoor space is within the predetermined range of the set point temperature, cause the dryer appliance to automatically switch to one of a vented mode and a non-vented mode.

6. The dryer appliance of claim 5, wherein in the vented mode, the controller causes the vent damper to move to the open position and the vent fan to move cabinet air through the vent of the cabinet, and wherein in the non-vented mode, the controller causes the vent damper to move to the closed position such that cabinet air moves into the indoor space.

7. The dryer appliance of claim 1, wherein the process air flowpath is a closed loop airflow circuit.

8. The dryer appliance of claim 1, wherein the vent is in fluid communication with an inlet of a vent system, the vent system having an outlet in fluid communication with an outdoor space.

9. The dryer appliance of claim 1, wherein the conditioning system is a heat pump system.

10. The dryer appliance of claim 1, wherein the conditioning system has an electric heater.

11. The dryer appliance of claim 1, wherein the vent fan is operable to move at least forty cubic feet per minute of cabinet air through the vent of the cabinet.

12. A method of operating a dryer appliance having cabinet defining an interior volume and a drum rotatably mounted therein, the method comprising:

moving, by a blower fan, process air along a process air flowpath of the dryer appliance, the process air flowpath being a closed loop airflow circuit;

heating, by a conditioning system, process air moving along the process air flowpath;

venting, by a vent fan, cabinet air disposed within the interior volume of the cabinet and outside of the drum through a vent defined by the cabinet.

13. The method of claim 12, wherein process air moving along the process air flowpath and the conditioning system impart thermal energy to cabinet air disposed within the interior volume of the cabinet.

14. The method of claim 12, wherein the vent fan is disposed within the interior volume of the cabinet and outside of the drum.

15. The method of claim 12, wherein the dryer appliance is positioned within an indoor space, and wherein the vent of the cabinet is in fluid communication with an outdoor space, and wherein when the vent fan vents cabinet air disposed within the interior volume of the cabinet and outside of the drum through the vent defined by the cabinet, cabinet air is vented to the outdoor space.

16. The method of claim 12, wherein the conditioning system of the dryer appliance is a heat pump having a sealed system.

17. The method of claim 12, wherein a vent damper is positioned at the vent of the cabinet, the vent damper being movable between an open position in which cabinet air exits the interior volume of the cabinet through the vent and a closed position in which cabinet air is prevented from exiting the interior volume of the cabinet through the vent, and wherein the method further comprises:

moving the vent damper to the open position so that cabinet air is vented through the vent.

18. The method of claim 12, wherein a vent damper is positioned at the vent of the cabinet, the vent damper being movable between an open position in which cabinet air exits the interior volume of the cabinet through the vent and a closed position in which cabinet air is prevented from exiting the interior volume of the cabinet through the vent, and wherein the method further comprises:

receiving, by a controller of the dryer appliance and from a temperature sensor, an input indicative of a temperature of air within an outdoor space;

determining whether the temperature of air within the outdoor space has passed a threshold temperature, and when the temperature of air within the outdoor space has passed the threshold temperature, causing, by the controller, the dryer appliance to automatically switch to one of a vented mode and a non-vented mode, and wherein in the vented mode, the controller causes the vent damper to move to the open position and the vent fan to move cabinet air through the vent of the cabinet, and wherein in the non-vented mode, the controller causes the vent damper to move to the closed position.

19. The method of claim 12, wherein a vent damper is positioned at the vent of the cabinet, the vent damper being movable between an open position in which cabinet air exits the interior volume of the cabinet through the vent and a closed position in which cabinet air is prevented from exiting the interior volume of the cabinet through the vent, and wherein the method further comprises:

receiving, by a controller and from a temperature sensor, an input indicative of a temperature of air within an indoor space in which the dryer appliance is positioned;

receiving, by the controller, an input indicative of a set point temperature for air within the indoor space;

determining whether the temperature of air within the indoor space is within a predetermined range of the set point temperature, and in response to whether the temperature of air within the indoor space is within the predetermined range of the set point temperature, causing, by the controller, the dryer appliance to automatically switch to one of a vented mode and a non-vented mode.

* * * * *